US009469149B2

(12) United States Patent
Huang

(10) Patent No.: US 9,469,149 B2
(45) Date of Patent: Oct. 18, 2016

(54) SELF-LOCKING ACTUATOR FOR RING BINDER MECHANISM

(71) Applicant: World Wide Stationery Mfg. Co., Ltd., Kwai Chung, New Territory, Hong Kong (CN)

(72) Inventor: Ming Hua Huang, Dong Guan (CN)

(73) Assignee: World Wide Stationery Mfg. Co., Ltd., Kwai Chung, New Territories (HK)

( * ) Notice: Subject to any disclaimer, the term of this patent is extended or adjusted under 35 U.S.C. 154(b) by 76 days.

(21) Appl. No.: 14/539,770

(22) Filed: Nov. 12, 2014

(65) Prior Publication Data

US 2015/0071699 A1 Mar. 12, 2015

Related U.S. Application Data

(63) Continuation of application No. 13/528,530, filed on Jun. 20, 2012, now Pat. No. 8,899,866.

(30) Foreign Application Priority Data

Apr. 28, 2012 (CN) ..... 2012 1 0142483
Apr. 28, 2012 (CN) ..... 2012 2 0207227

(51) Int. Cl.
*B42F 13/20* (2006.01)
*B42F 13/16* (2006.01)
(Continued)

(52) U.S. Cl.
CPC ..... *B42F 13/22* (2013.01); *B42F 13/16* (2013.01); *B42F 13/20* (2013.01); *B42F 13/26* (2013.01); *B42F 13/36* (2013.01)

(58) Field of Classification Search
CPC ..... B42F 13/00; B42F 13/16; B42F 13/20; B42F 13/26; B42F 13/28
USPC ..... 402/26, 38, 41
See application file for complete search history.

(56) References Cited

U.S. PATENT DOCUMENTS 419,160 A 1/1890 Smith
566,717 A 8/1896 Krah
(Continued)

FOREIGN PATENT DOCUMENTS

CA 2500817 A1 9/2005
CN 102126374 A 7/2011
(Continued)

OTHER PUBLICATIONS

Supplementary European Search Report dated Dec. 2, 2015 in related European Patent Application No. 13780704.6, 8 pages.
(Continued)

*Primary Examiner* — Kyle Grabowski
(74) *Attorney, Agent, or Firm* — Senniger Powers

(57) ABSTRACT

A ring binder mechanism for holding loose-leaf pages has a housing having a cavity formed in the underside of a central portion of the housing. A pair of hinge plates are disposed between the sides for pivoting movement relative to the housing to open and close rings of the mechanism. The mechanism has an actuator moveable relative to the housing for opening and closing the rings. The actuator has a body, an opening arm extending from the body, a closing arm extending from the body, and a locking finger extending from the body. The closing arm extending into a space between the hinge plates and the central portion of the housing. The hinge plates extend between the opening and closing arms. The locking finger extends into the cavity in the central portion of the housing when the actuator is in the closed position.

12 Claims, 19 Drawing Sheets

(51) Int. Cl.

| | |
|---|---|
| ***B42F 13/26*** | (2006.01) |
| ***B42F 13/28*** | (2006.01) |
| ***B42F 13/22*** | (2006.01) |
| ***B42F 13/36*** | (2006.01) |

(56) References Cited

U.S. PATENT DOCUMENTS 621,256 A 3/1899 Krah
651,254 A 6/1900 Krah
683,019 A 9/1901 Buchanan
779,879 A 1/1905 Sheridan et al.
790,382 A 5/1905 McBride
854,074 A 5/1907 Bryant
857,377 A 6/1907 Baker
974,831 A 11/1910 Scherzinger
1,011,391 A 12/1911 Sturgis
1,163,179 A 12/1915 Schade, Jr.
1,168,260 A 1/1916 Albrecht
1,398,034 A 11/1921 Mero
1,398,388 A 11/1921 Murphy
1,598,206 A 8/1926 Lindstedt et al.
1,733,548 A 10/1929 Martin
1,733,894 A 10/1929 Martin
1,787,957 A 1/1931 Schade
1,822,669 A 9/1931 Schade
1,824,791 A 9/1931 Rengmann
1,857,291 A 5/1932 Trussell
1,896,839 A 2/1933 Dawson
1,953,981 A 4/1934 Trussell
1,991,362 A 2/1935 Krag
1,996,463 A 4/1935 Dawson et al.
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,075,767 A 3/1937 Rand
2,081,372 A 5/1937 Thomas
2,089,211 A 8/1937 Krag
2,096,944 A 10/1937 Unger et al.
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis et al.
2,251,878 A 8/1941 Hanna et al.
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson, Jr.
2,543,866 A 3/1951 Panfil, Sr.
2,552,076 A 5/1951 Wedge
2,570,323 A 10/1951 Condon et al.
2,612,169 A 9/1952 Segal
2,789,561 A 4/1957 Bonn et al.
2,865,377 A 12/1958 Schroer et al.
2,871,711 A 2/1959 Stark
2,891,553 A 6/1959 Acton
2,894,513 A 7/1959 Gempe et al.
2,950,719 A 8/1960 Lyon
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,222,679 A 9/1980 Luogameno
4,352,582 A 10/1982 Eliasson
4,486,112 A 12/1984 Cummins
4,522,526 A 6/1985 Lozfau et al.
4,566,817 A 1/1986 Barrett, Jr.
4,571,108 A 2/1986 Vogl
4,690,580 A 9/1987 Kissel
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,919,557 A 4/1990 Podosek
5,067,840 A 11/1991 Cooper et al.
5,116,157 A 5/1992 Gillum et al.
5,135,323 A 8/1992 Pinheiro
5,180,247 A * 1/1993 Yu ..... B42F 13/26 402/38
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,524,997 A 6/1996 von Rohrscheidt
5,577,852 A 11/1996 To
5,634,666 A 6/1997 Lee
5,651,628 A 7/1997 Bankes et al.
5,660,490 A 8/1997 Warrington
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,810,500 A 9/1998 Whaley
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A 4/1999 Wu
5,904,435 A 5/1999 Tung
5,924,811 A 7/1999 To et al.
5,957,611 A 9/1999 Whaley
5,975,784 A 11/1999 Whaley
5,975,785 A 11/1999 Chan
6,036,394 A 3/2000 Cheng
6,142,697 A 11/2000 Williams
6,146,042 A 11/2000 To et al.
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 8/2001 Snyder et al.
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To

(56) References Cited

U.S. PATENT DOCUMENTS

| | | | |
|---|---|---|---|
| 6,749,357 | B2 | 6/2004 | Cheng |
| 6,758,621 | B2 | 7/2004 | To |
| 6,821,045 | B2 | 11/2004 | Whaley |
| 6,840,695 | B2 | 1/2005 | Horn |
| 6,916,134 | B2 | 7/2005 | Wong |
| 7,223,040 | B2 | 5/2007 | Koike et al. |
| 7,270,496 | B2 | 9/2007 | Morgan et al. |
| 7,275,886 | B2 | 10/2007 | Cheng |
| 7,296,946 | B2 | 11/2007 | Cheng et al. |
| 7,404,685 | B2 | 7/2008 | Cheng |
| 7,478,963 | B2 | 1/2009 | Tanaka et al. |
| 7,491,006 | B2 | 2/2009 | Whaley |
| 7,524,127 | B2 | 4/2009 | Petrie et al. |
| 7,524,128 | B2 | 4/2009 | Cheng |
| 7,530,755 | B2 | 5/2009 | Whaley |
| 7,534,064 | B2 | 5/2009 | Cheng |
| 7,549,817 | B2 | 6/2009 | Cheng et al. |
| 7,648,302 | B2 | 1/2010 | Zhang et al. |
| 7,661,898 | B2 | 2/2010 | Ng et al. |
| 7,661,899 | B2 | 2/2010 | Lin |
| 7,665,926 | B2 | 2/2010 | Cheng |
| 7,674,062 | B2 | 3/2010 | Horn |
| 7,726,897 | B2 | 6/2010 | To et al. |
| 7,731,441 | B2 | 6/2010 | Ng et al. |
| 7,748,922 | B2 | 7/2010 | Cheg |
| 7,819,602 | B2 | 10/2010 | To et al. |
| 7,828,491 | B2 | 11/2010 | Cheng |
| 8,052,343 | B2 | 11/2011 | Zhang et al. |
| 8,186,899 | B2 | 5/2012 | Ng et al. |
| 2003/0044221 | A1 | 3/2003 | To et al. |
| 2005/0201818 | A1 | 9/2005 | Cheng |
| 2005/0207826 | A1 | 9/2005 | Cheng et al. |
| 2006/0008318 | A1 | 1/2006 | Ng |
| 2006/0056906 | A1 | 3/2006 | Horn |
| 2006/0147254 | A1 | 7/2006 | Cheng |
| 2006/0251467 | A1 | 11/2006 | Cheng |
| 2007/0086836 | A1 | 4/2007 | Cheng |
| 2007/0140780 | A1 | 6/2007 | Petrie et al. |
| 2008/0008519 | A1 | 1/2008 | To |
| 2008/0075527 | A1 | 3/2008 | Pi et al. |
| 2009/0035053 | A1 | 2/2009 | Pi et al. |
| 2009/0060631 | A1 | 3/2009 | To et al. |
| 2009/0110469 | A1 | 4/2009 | To et al. |
| 2009/0110470 | A1 | 4/2009 | To et al. |
| 2010/0166490 | A1 | 7/2010 | Cheng et al. |
| 2011/0170942 | A1* | 7/2011 | Huang ..... B42F 13/26 402/31 |
| 2013/0287476 | A1 | 10/2013 | Huang |

FOREIGN PATENT DOCUMENTS

| | | | |
|---|---|---|---|
| CN | 102529498 | A | 7/2012 |
| EP | 1431065 | EP | 6/2004 |
| FR | 1336765 | A | 9/1963 |
| FR | 1346864 | A | 12/1963 |
| FR | 2221924 | | 10/1974 |
| FR | 2238332 | A5 | 2/1975 |
| GB | 837875 | A | 6/1960 |
| GB | 868724 | | 5/1961 |
| GB | 906279 | | 9/1962 |
| GB | 952536 | | 3/1964 |
| GB | 2275023 | A | 8/1994 |
| GB | 2292343 | A | 2/1996 |
| GB | 2387815 | A | 10/2003 |
| JP | 5979379 | U | 5/1984 |
| JP | 6118880 | U | 2/1986 |
| JP | 62-189178 | U | 12/1987 |
| JP | 1299095 | A | 12/1989 |
| JP | 2034289 | U | 3/1990 |
| JP | 4120085 | U | 10/1992 |
| JP | 06-171287 | | 6/1994 |
| JP | 10-217662 | A | 8/1998 |
| JP | 10-329470 | | 12/1998 |
| JP | 2004098417 | A | 4/2004 |
| WO | 2013026351 | A1 | 3/2009 |

OTHER PUBLICATIONS

Kokuyo Lock Ring Mechanism with description, two instruction sheets, and nine photographs, date unknown but admitted as prior art, 12 pgs.

International Search Report dated Aug. 1, 2013 in related application PCT/CN2013/074798, 9 pages.

Written Opinion dated Aug. 1, 2013 in related application PCT/CN2013/074798, 5 pages.

International Preliminary Report on Patentability dated Nov. 6, 2014 in related application PCT/CN2013/074798, 7 pages.

Office Action dated Jan. 12, 2016 in related Chinese Application No. 201210142483.X, 19 pages.

* cited by examiner

SELF-LOCKING ACTUATOR FOR RING BINDER MECHANISM

CROSS REFERENCE TO RELATED APPLICATIONS

This application is a continuation of U.S. patent application Ser. No. 13/528,530, filed Jun. 20, 2012, which claims priority to Chinese Patent Application No. 201210142483.X, filed Apr. 28, 2012 and Chinese Utility Model Patent Application No. 201220207227.X, filed Apr. 28, 2012, the entire contents of which are all hereby incorporated by reference.

FIELD OF THE INVENTION

This invention relates to a ring binder mechanism for retaining loose-leaf pages, and in particular to a ring binder mechanism having a locking feature that reduces the risk that the rings may accidentally open.

BACKGROUND

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis.

A housing loosely supports the hinge plates within the housing and holds the hinge plates together so they may pivot relative to the housing. The housing has a generally arch-shaped cross-section, with bent-under rims that hold the hinge plates within the housing. The hinge plates are disposed within and extend across the open bottom part of the arch spaced from the top of the arch and the ring members extend through notches or openings in the housing or in some cases around the sides of the housing.

The undeformed housing is narrower than the joined hinge plates when the hinge plates are in a coplanar position (180°). So as the hinge plates pivot through this coplanar position, they deform the resilient housing laterally outwardly and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator can overcome this force by manually pulling the ring members apart or pushing them together. Levers may also be provided on one or both ends of the housing for moving the ring members between the open and closed positions.

Some ring mechanisms include locking structure(s) that block the hinge plates from pivoting when the ring members are closed. The locking structure positively locks the closed ring members together, preventing them unintentionally opening if the ring mechanism is accidentally dropped. For example, locking structures can be incorporated on a control slide or travel bar moveable relative to the housing between a locking position in which locking elements block pivoting movement of the hinge plates and non-locking position in which the locking elements do not block movement of the hinge plates. The presence of a locking feature may facilitate use of a housing that provides a weaker spring force tending to hold the rings in the closed position. This can be desirable because it can be painful if a user accidentally gets his or her finger pinched between the ring members, particularly when the spring force from the housing is strong. Moreover, it is desirable that the unlocking and opening functions can be achieved with a single action or movement by a user so the ring mechanism is more convenient to use. It is also desirable to have a locking feature that automatically locks the ring binder when they are moved to the closed position so that a user may also close and lock the ring mechanism using a single action or movement.

Although using a control slide or travel bar having locking elements that block movement of hinge plates when in the locking position is an effective way to provide the desired locking features there are some costs associated with the control slide.

SUMMARY OF THE INVENTION

One aspect of the invention is a ring binder mechanism for holding loose-leaf pages. The mechanism has a housing having a central portion and lateral sides extending downwardly along opposite side of the central portion. The housing has a cavity formed in the underside of the central portion of the housing. A pair of hinge plates are disposed between the lateral sides of the housing and supported by the housing for pivoting movement relative to the housing. The mechanism has a plurality of rings for holding the loose-leaf pages. Each ring includes a first ring member and a second ring member. The first ring member is mounted on one of the hinge plates of the pair of hinge plates for movement with the hinge plate relative to the housing between a closed position and an open position. The first and second ring members form a substantially continuous, closed loop in the closed position for allowing loose-leaf pages retained by the rings to be moved along the rings from one ring member to the other. The first and second ring members form a discontinuous, open loop in the open position for adding or removing loose-leaf pages from the rings. The mechanism has an actuator moveable relative to the housing between an open and closed position for producing movement of the rings between the open and closed positions. The actuator as a body, an opening arm extending from the body, a closing arm extending from the body, and a locking finger extending from the body. The closing arm extends into a space between the hinge plates and the central portion of the housing. The hinge plates extend between the opening and closing arms. The locking finger extends into the cavity in the central portion of the housing when the actuator is in the closed position.

Another aspect of the invention is a ring binder mechanism for holding loose-leaf pages. The mechanism has a housing having a central portion and lateral sides extending downwardly along opposite sides of the central portion. A pair of hinge plates are disposed between the lateral sides of the housing and supported by the housing for pivoting movement relative to the housing. The mechanism has a plurality of rings for holding the loose-leaf pages. Each ring includes a first ring member and a second ring member. The first ring member is mounted on one of the hinge plates of the pair of hinge plates for movement with the hinge plate relative to the housing between a closed position and an open position. The first and second ring members form a substantially continuous, closed loop in the closed position for allowing loose-leaf pages retained by the rings to be moved along the rings from one ring member to the other. The first and second ring members form a discontinuous, open loop in the open position for adding or removing loose-leaf pages from the rings. The mechanism has an actuator moveable relative to the housing between an open and closed position for producing movement of the rings between the open and closed positions. The actuator has a body, a handle extending from the body, an opening arm extending from the body, a closing arm extending from the body, and a locking finger extending from the body. The closing arm extends into a space between the hinge plates and the central portion of the housing. The hinge plates extend between the opening and closing arms. The locking finger is adapted to block movement of the closing arm toward the open position of the actuator in response to an upward force exerted on the closing arm by the hinge plates. The locking finger is adapted so it does not block movement of the actuator toward the open position in response to force applied to the handle to move the actuator toward the open position.

Yet another aspect of the invention is an actuator for moving the rings of a ring binder mechanism between open and closed position. The actuator has a body. A handle, opening arm, and closing arm each extend from the body. The closing arm has a relatively wider head and a relatively narrower neck connecting the head to the body of the actuator. The head of the closing arm is spaced from an end of the opening arm to form a notch for receiving hinge plates of the ring mechanism between the opening and closing arms. The actuator also has a locking finger extending from the body. The locking finger has an upturned end. The locking finger extends from the body at a location spaced from the neck of the closing arm toward the head of the closing arm. The upturned end of the locking finger is positioned adjacent the head of the closing arm.

Other features will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
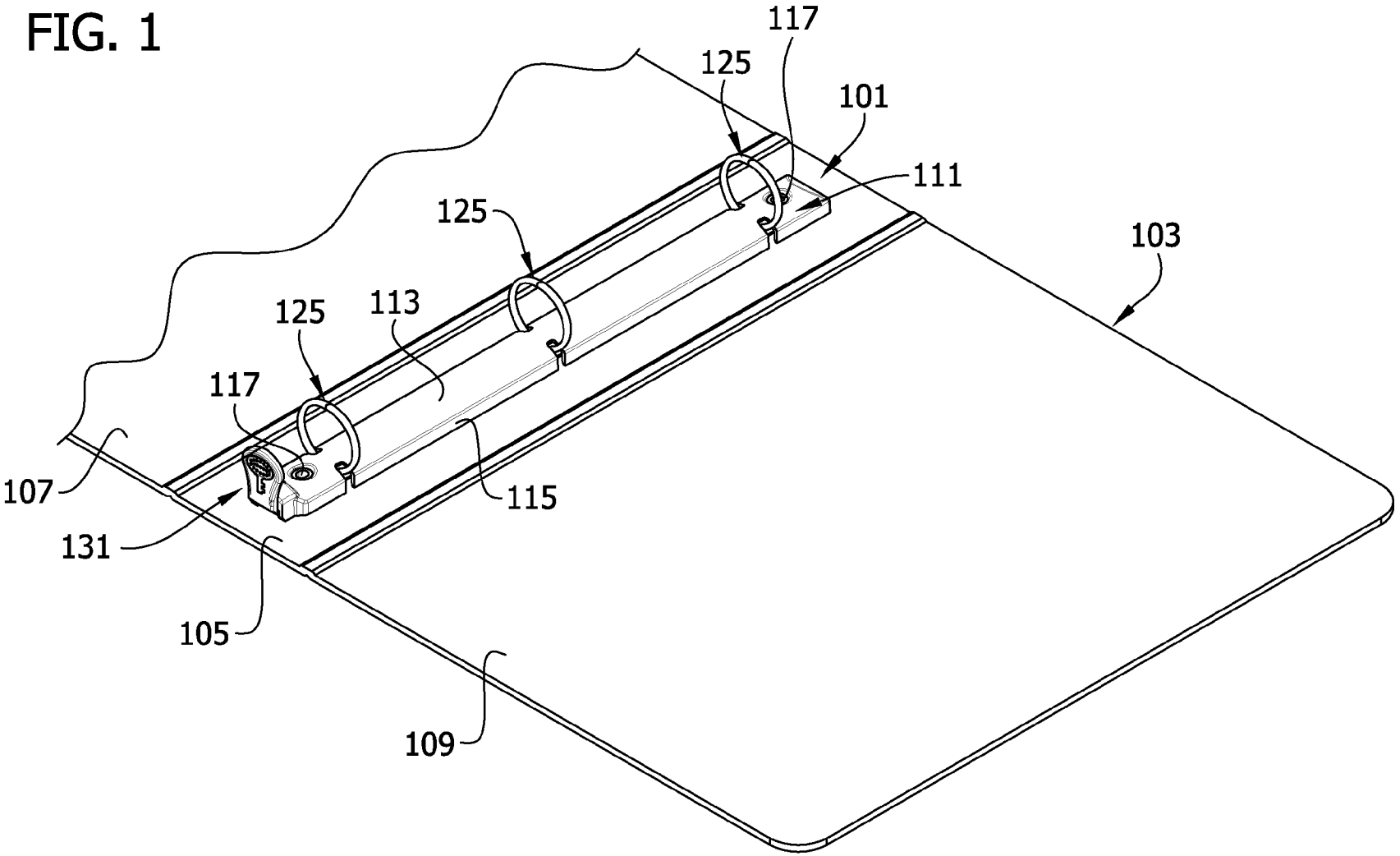
FIG. 1 is a perspective of one embodiment of a ring binder mechanism of the present invention.

Referring to FIGS. 1-14, one embodiment of a ring binder mechanism of the present invention is generally designated 101. As those skilled in the art will readily appreciate, the mechanism 101 is suitable for holding loose-leaf pages (not shown). As illustrated in FIG. 1, the ring binder mechanism 101 is secured (e.g., by rivets 117 or other suitable fasteners) to a notebook cover 103. For example, the notebook cover 103 in FIG. 1 has a spine 105 and front and back covers 107, 109 hingedly connected to the spine so the covers can be moved to selectively cover and uncover any loose-leaf pages retained by the ring mechanism 101. The ring binder mechanism 101 can be secured to the spine 105 or either of the front and back covers 107, 109 (e.g., adjacent the spine) within the scope of the invention. Moreover, the ring binder mechanism 101 can be used in combination with other objects (e.g., clip boards, briefcases, other office products, etc.) instead of a notebook cover or sold separately within the scope of the invention.

The ring binder mechanism 101 has a housing 111 that includes a central portion 113 and lateral sides 115 extending down from opposite sides of the central portion. The housing 111 is made of a resilient material. The housing 111 in the illustrated embodiment is a one-piece unitary structure. For example, the housing 111 is suitably molded as one piece (e.g., in an injection molding apparatus) from a moldable polymeric material. The housing 111 can also be made of metal or other resilient materials within the scope of the invention.

Figure 2:
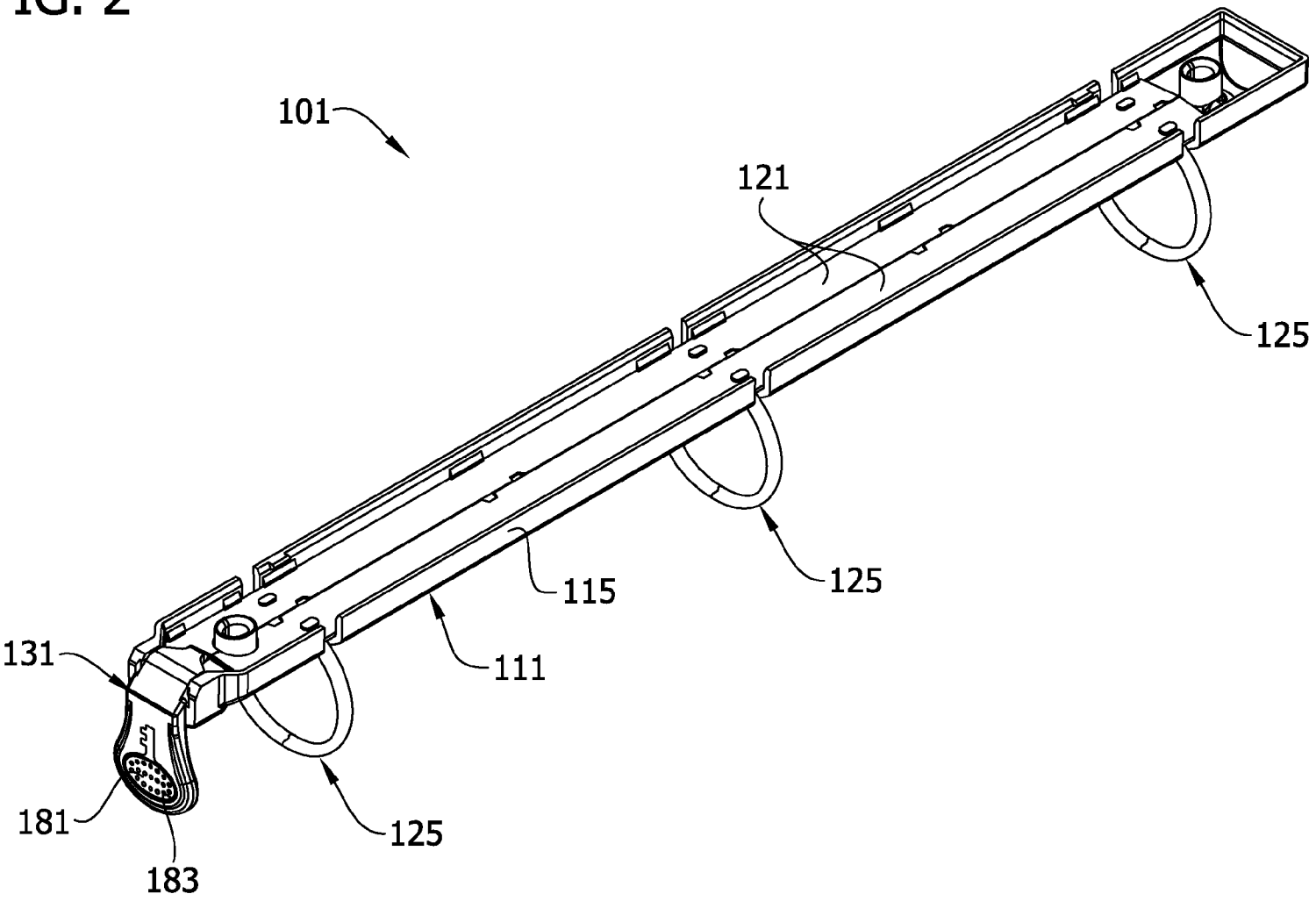
FIG. 2 is another perspective of the ring binder mechanism from a different vantage point.
Figure 3:
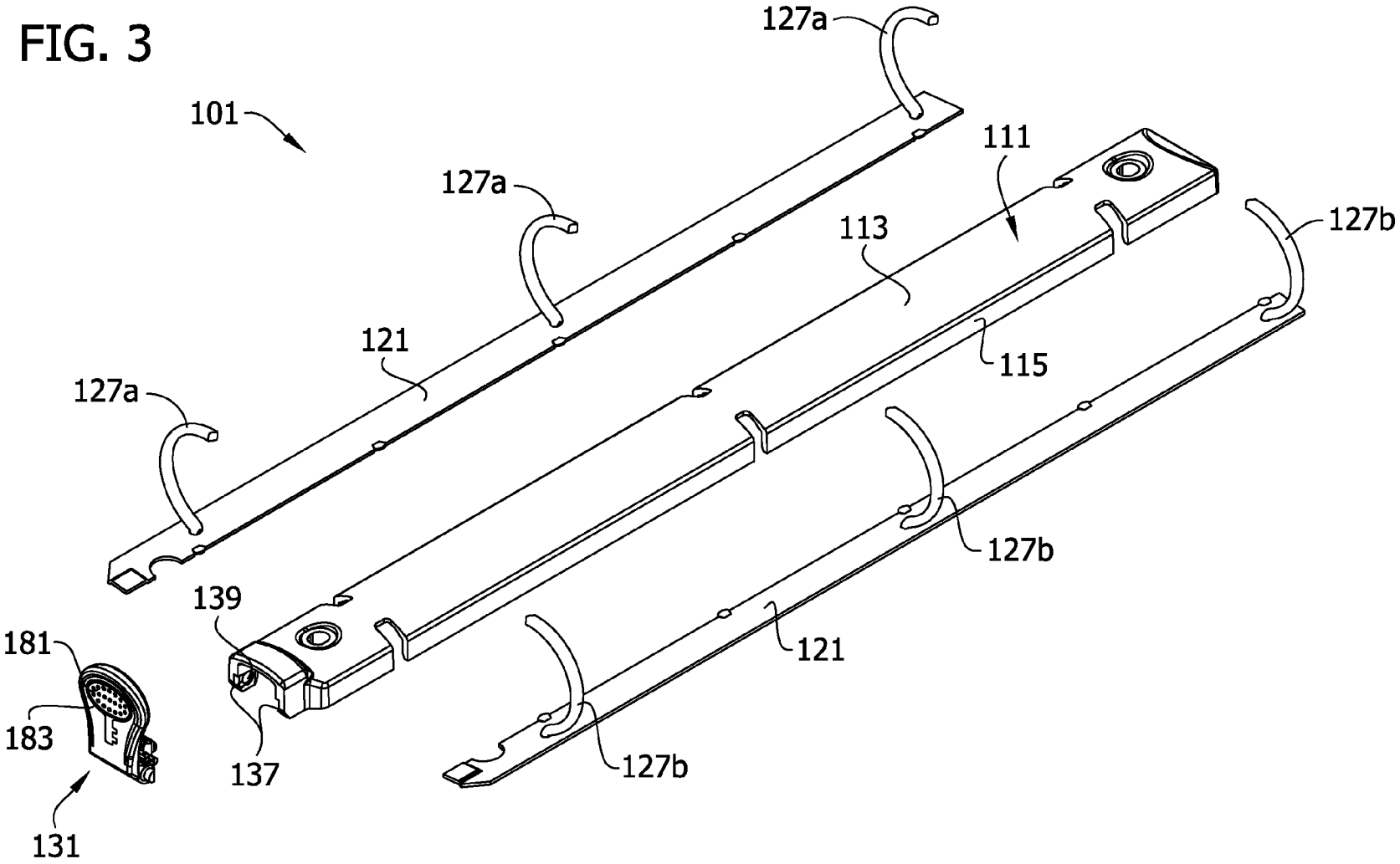
FIG. 3 is an exploded perspective of the ring binder mechanism.
Figure 8:
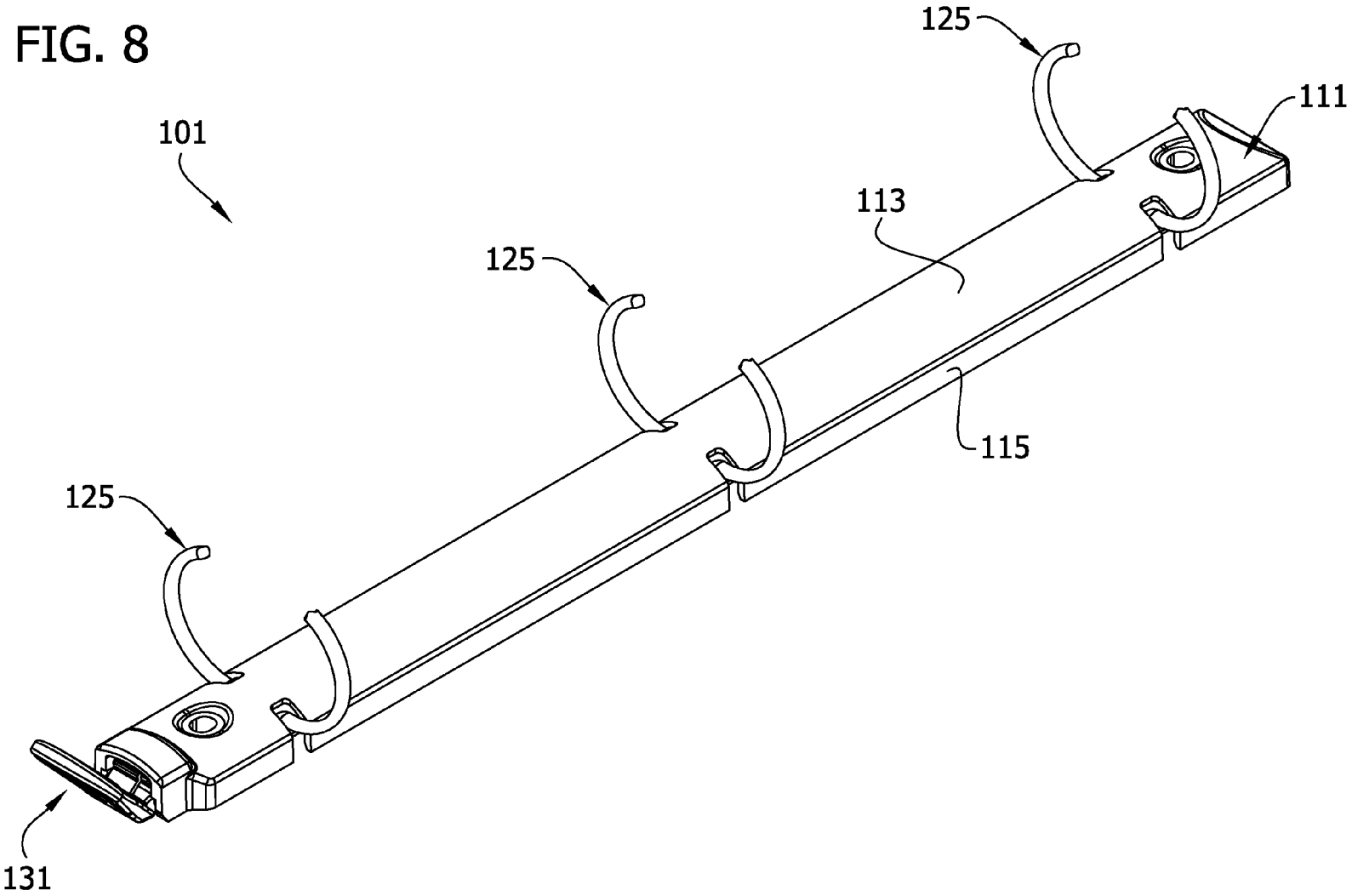
FIG. 8 is a perspective of the ring binder mechanism showing rings thereof in an open position.

A pair of hinge plates 121 are disposed between the sides 115 of the housing 111, as illustrated in FIG. 2. The housing 111 supports the hinge plates 121 for pivoting movement relative to the housing 111 between a closed position (FIG. 1) and an open position (FIG. 8). The combined width of the hinge plates 121 is slightly larger than the distance between the sides 115 of the housing. Thus, the resilient housing 111 applies a spring force to the hinge plates 121 tending to hold the hinge plates in the closed position when they are proximate the closed position and tending to hold the hinge plates in the open position when they are proximate the open position. When the hinge plates 121 are pivoted between the open and closed positions, a toggling action occurs as the hinge plates pass through an orientation in which they are co-planar with one another, thereby reversing the direction the hinge plates are biased to move toward by the housing. The hinge plates 121 in the illustrated embodiment are suitably made of metal (e.g., stainless steel), although other materials can be used within the broad scope of the invention.

The mechanism 101 has a plurality of rings 125 for holding the loose-leaf pages. Each ring 125 in the illustrated embodiment includes a first ring member 127*a* and a second ring member 127*b*. The first ring member 127*a* is mounted on one of the hinge plates 121 for movement with the hinge plate relative to the housing between a closed position and an open position of the rings 125. When the ring members 127*a*, 127*b* are in the closed position (FIG. 1), they form a substantially continuous, closed loop for allowing loose-leaf pages retained by the rings 125 to be moved along the rings from one ring member to the other. When the ring members 127*a*, 127*b* are in the open position (FIG. 8) they form a discontinuous, open loop for adding or removing loose-leaf pages from the rings. In the illustrated embodiment, the ring members 127*a*, 127*b* are substantially identical. However, the shape of one of the ring members in each ring can be different from the other ring member within the scope of the invention. Also, in the illustrated embodiment each ring member 127*a*, 127*b* of each ring 125 is mounted on one of the hinge plates 121, but it is possible that one of the ring members for each ring is not mounted on either of the hinge plates (e.g., one of the ring members may be a fixed ring member secured to the housing 111) within the scope of the invention.

The ring binder mechanism 101 includes at least one self-locking actuator 131 adapted to be moved by person relative to the housing 111 to open and close the rings 125. The embodiment illustrated in FIGS. 1-14 has a single self-locking actuator 131 at one end of the housing 111. The actuator 131 is suitably adapted to be snapped into connection with the housing 111 during assembly of the ring mechanism 101. For example, as illustrated in FIGS. 4-7, the actuator 131 has a pair of pivot members 133 extending from opposite sides of the actuator. The ends 135 of the pivot members 133 are beveled to facilitate sliding the pivot members through channels 137 (FIG. 3) extending from the end of the housing 111 inward along the sides 115 of the housing to receptacles 139 in which the pivot members 133 are received and retained in the assembled state of the ring binder mechanism 101. Additional details about the construction of ring binder mechanisms having an actuator having a snap-lock connection with a housing are set forth in commonly owned U.S. Pat. No. 8,147,160, the contents of which are hereby incorporated by reference.

The actuator 131 is moveable relative to the housing 111 between a closed position (FIGS. 1, 9, and 10) and an open position (FIGS. 8, 13, and 14) for producing movement of the rings 125 between the open and closed positions. In the illustrated embodiment, the actuator 131 is mounted for pivoting movement relative to the housing 111 (e.g., on the pivot members 133) between the open and closed positions. However, the actuator can be mounted for other types of movement relative to the housing (e.g., a combination of rotation and translation) within the broad scope of the invention.

Figure 9:
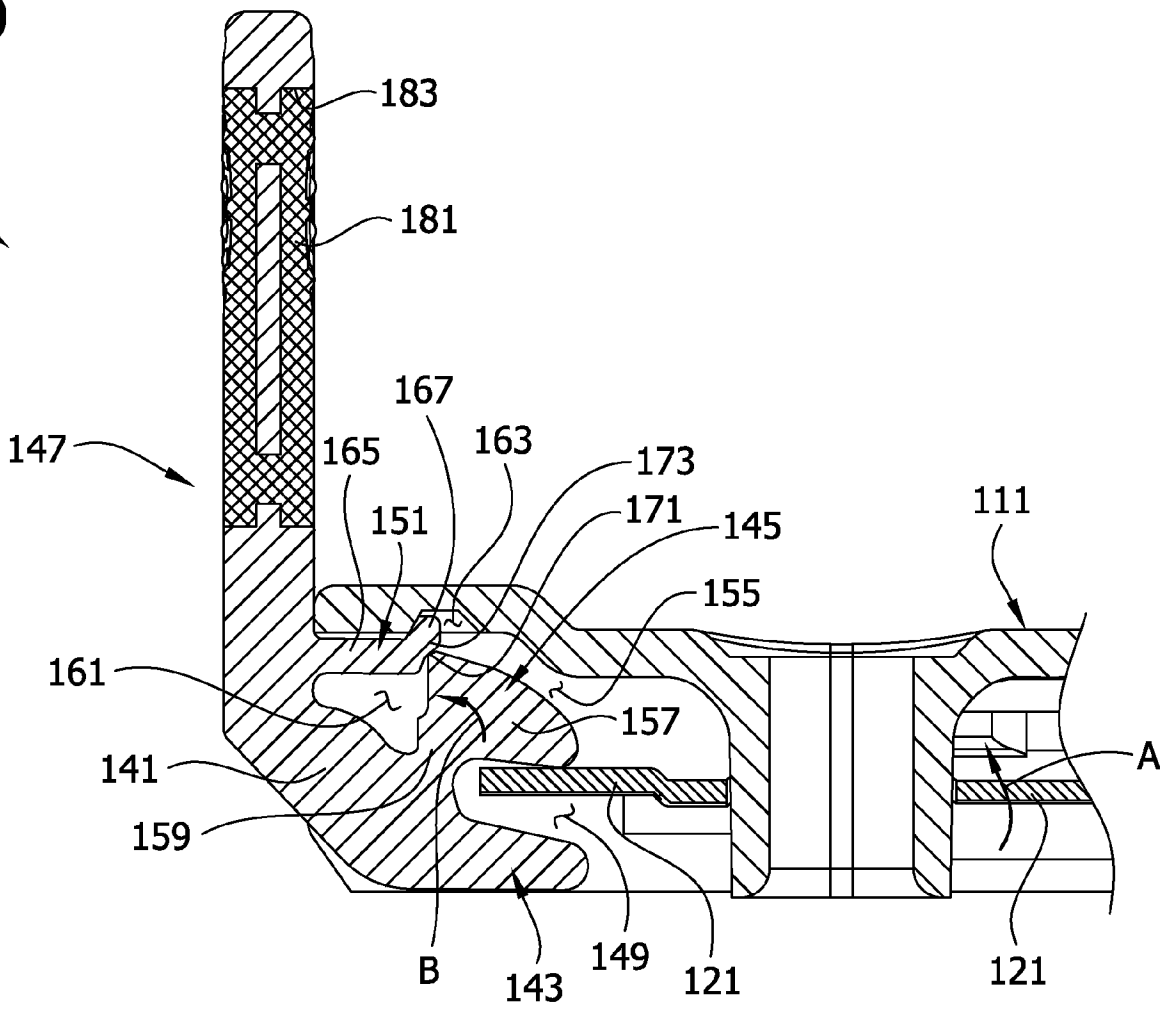
FIG. 9 is an enlarged longitudinal cross section of a fragment of the ring binder mechanism showing the rings in a closed position and the actuator blocking movement of the rings toward the open position.

As illustrated in FIGS. 4-7, the actuator 131 includes a main body 141, an opening arm 143 extending from the body, a closing arm 145 extending from the body, a handle 147 extending from the body, and a locking finger 151 extending from the body. The handle 147 is suitably a lever oriented to extend upward when the actuator 131 is in the closed position. As illustrated in FIG. 9, the base of the handle 147 abuts the end of the central portion 113 of the housing 111 and extends vertically above the housing when the actuator 131 is in the closed position.

Figure 4:
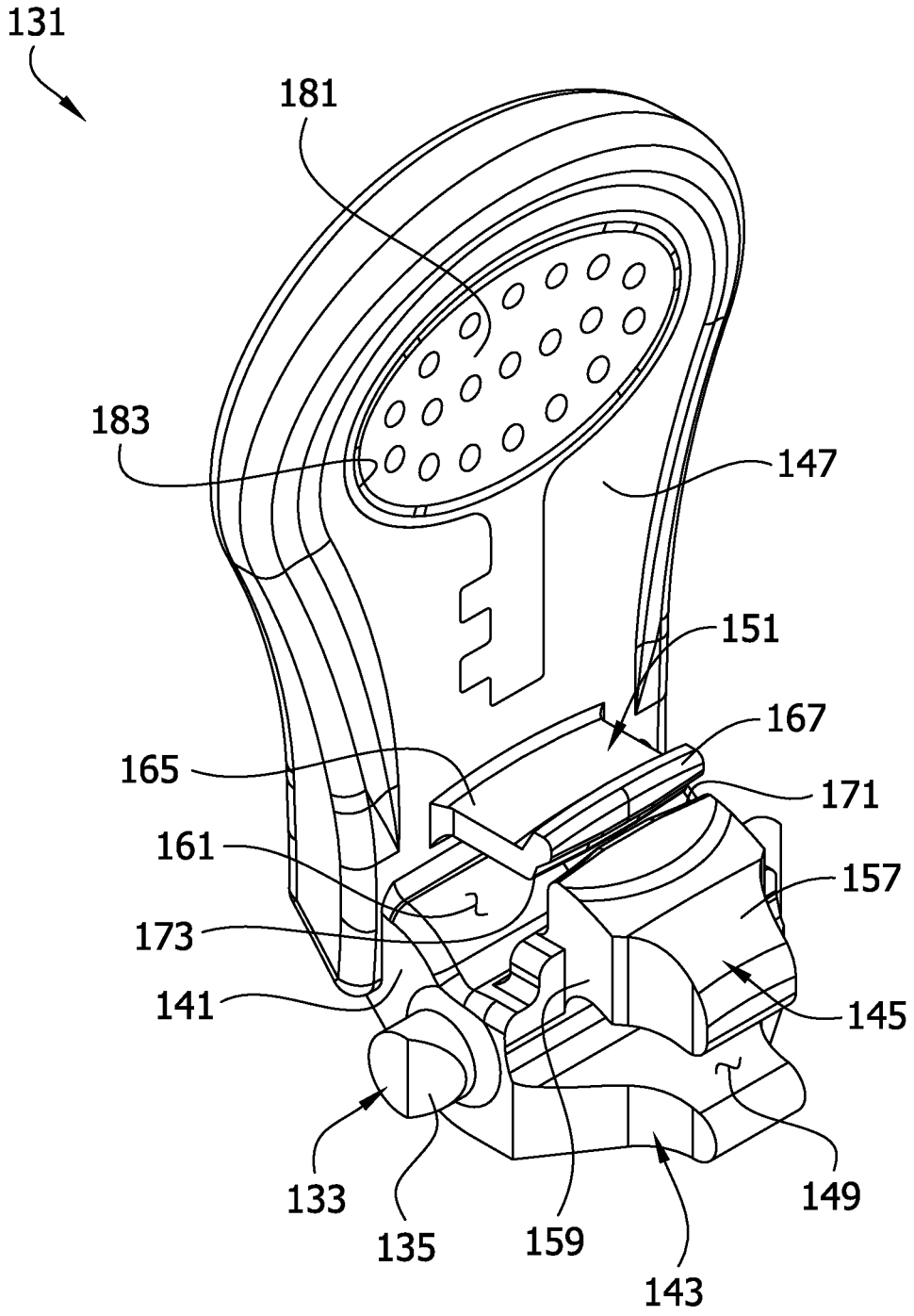
FIG. 4 is an enlarged perspective of one embodiment of an actuator of the ring binder mechanism.
Figure 5:
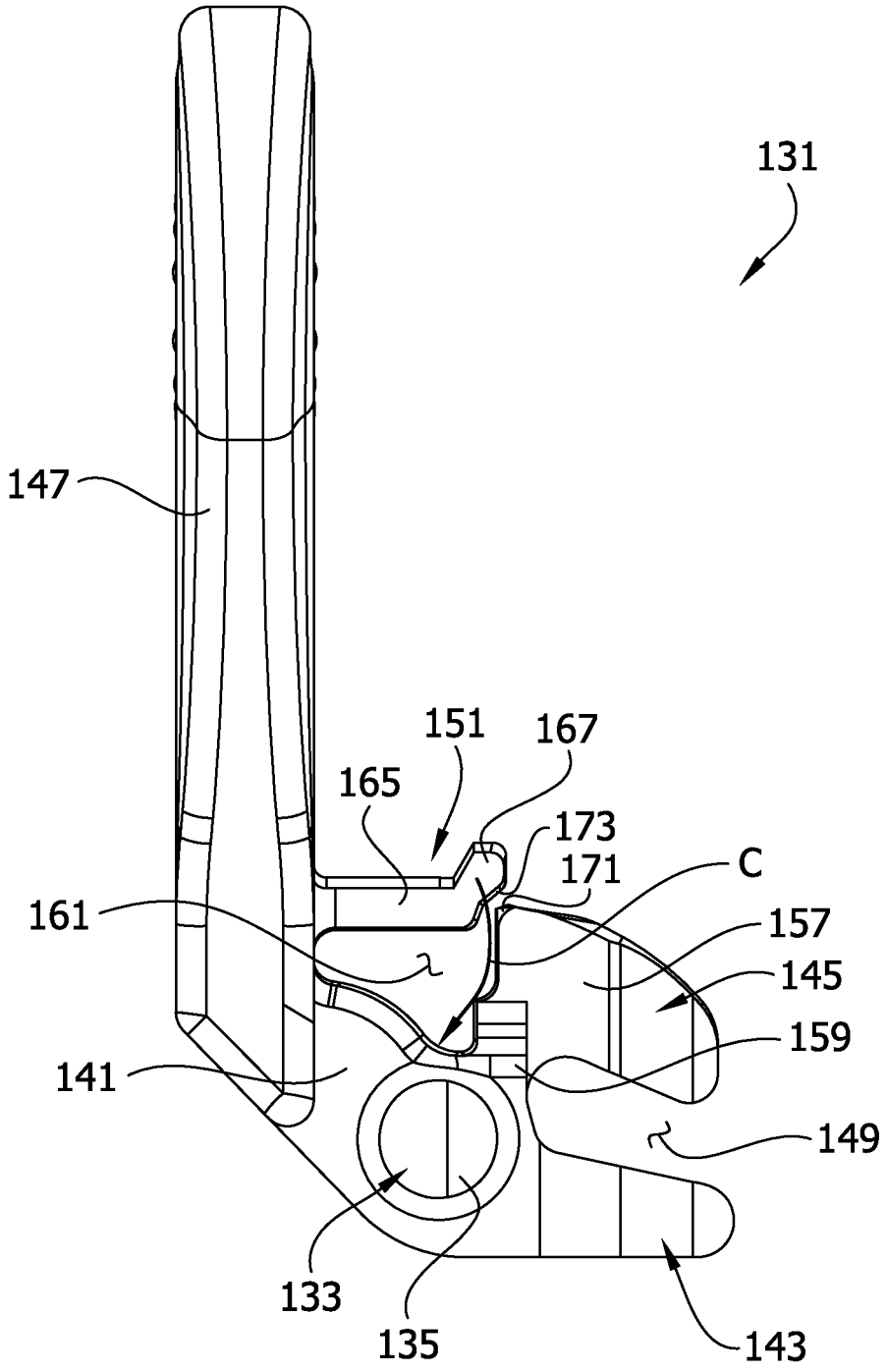
FIG. 5 is an enlarged side elevation of the actuator.
Figure 6:
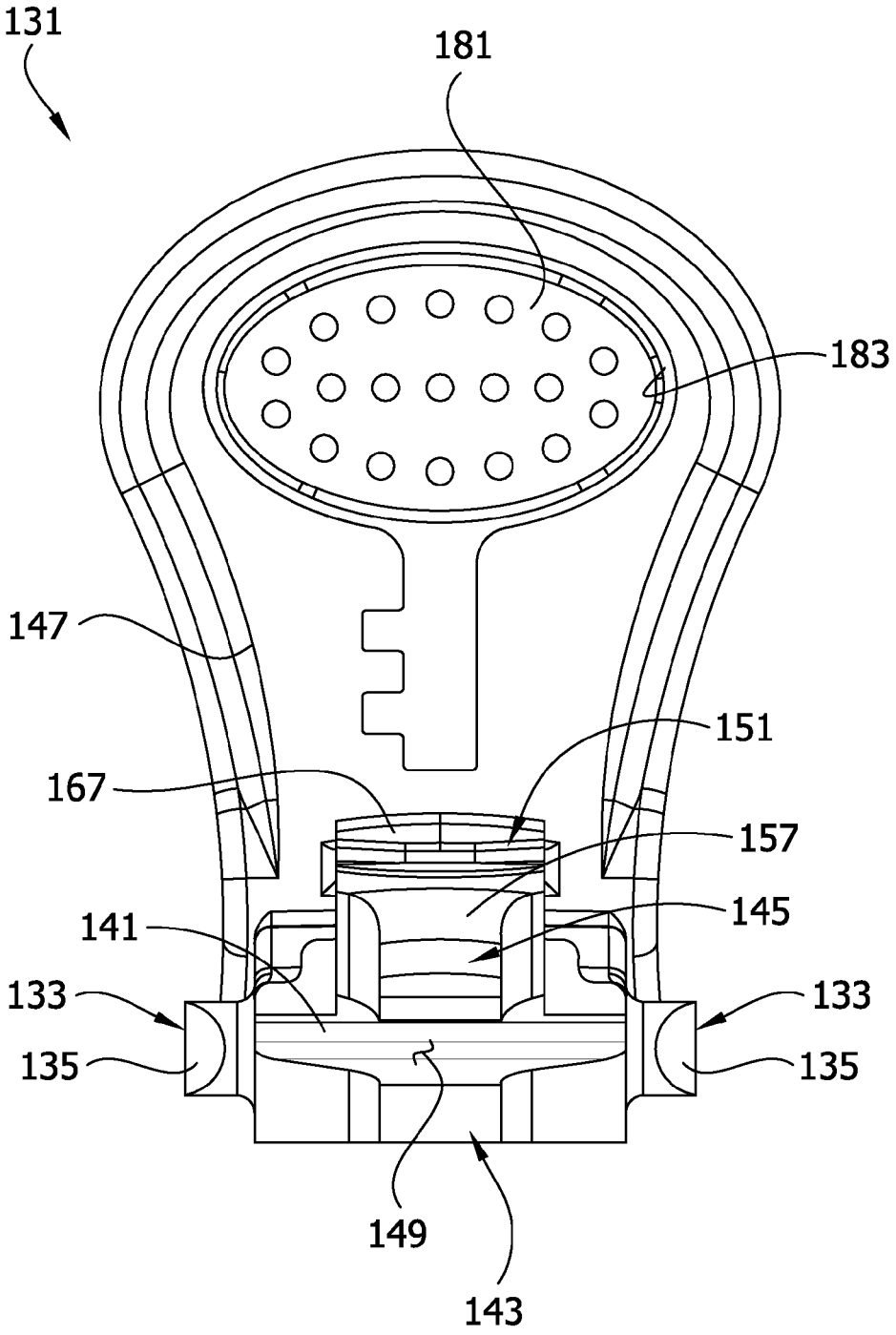
FIG. 6 is an enlarged front elevation of the actuator.
Figure 7:
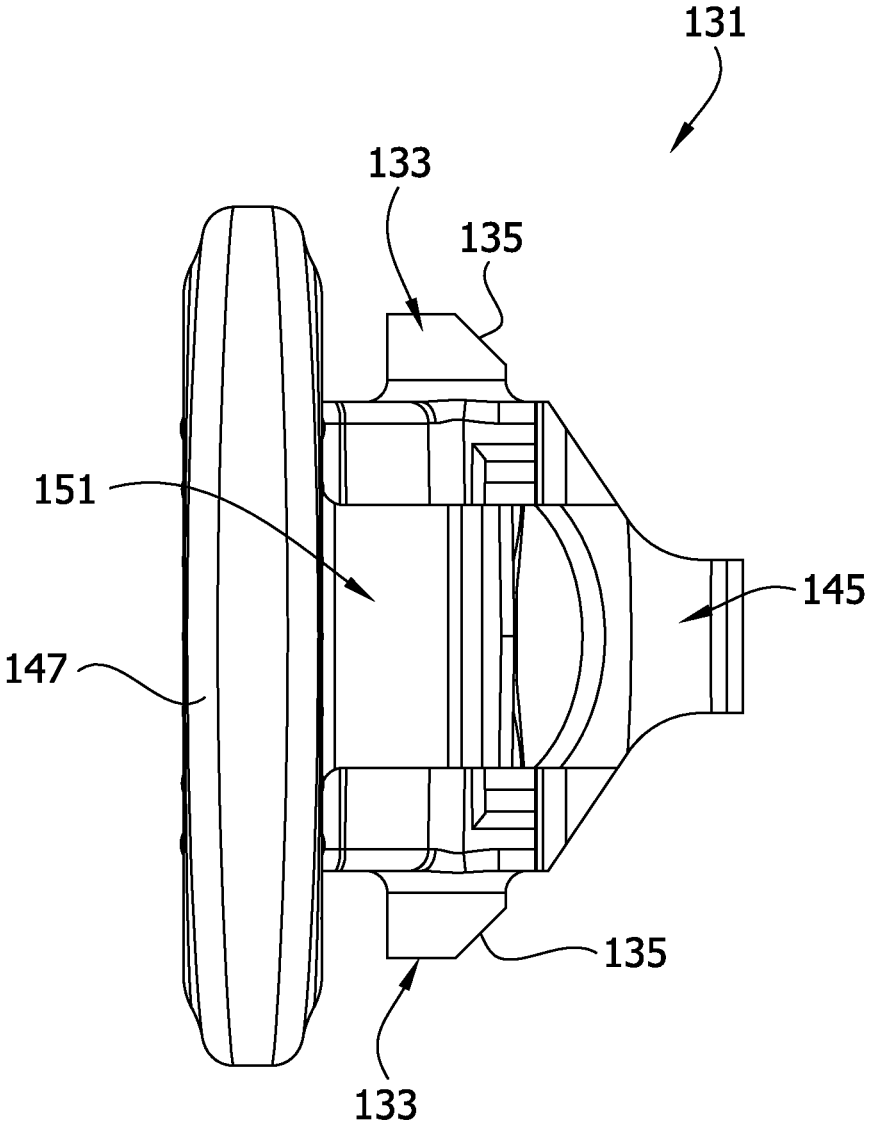
FIG. 7 is an enlarged top plan of the actuator.

The body 141, opening arm 143, closing arm 145, handle 147, and locking finger 151 of the actuator 131 are suitably formed as a one piece unitary body. For example, the body 141, opening arm 143, closing arm 145, and handle 147 can suitably be molded as one piece from a moldable polymeric material (e.g., in an injection molding apparatus) and then an insert 181 (e.g., made of a relatively soft elastomeric material or other material that is selected for its aesthetically pleasing tactile properties) can be inserted into an opening 183 in the handle 147 to provide a soft-grip portion of the actuator 131, as illustrated in FIGS. 4-6. The insert 181 of the embodiment shown in the drawings has a circumferential groove 187 (FIG. 10) and the opening 183 suitably has one or more radially inward extending projections 185 (e.g., tabs or one or more ribs) that are received in the groove to retain the insert in position relative to the rest of the actuator 131. Alternatively, if desired a grip and/or cushion (not shown) can be placed on the handle of a one-piece actuator to facilitate gripping of the handle by a person and/or cushion the person's fingers while using the actuator to open or close the rings. In another alternative, the entire actuator is suitably molded as one piece from a moldable polymeric material (e.g., in an injection molding apparatus) without any soft insert, cushion or other separate grip. Further, an actuator having a body, handle, closing arm, opening arm, and locking finger can also be made by combining multiple separately-formed pieces within the broad scope of the invention.

Figure 10:
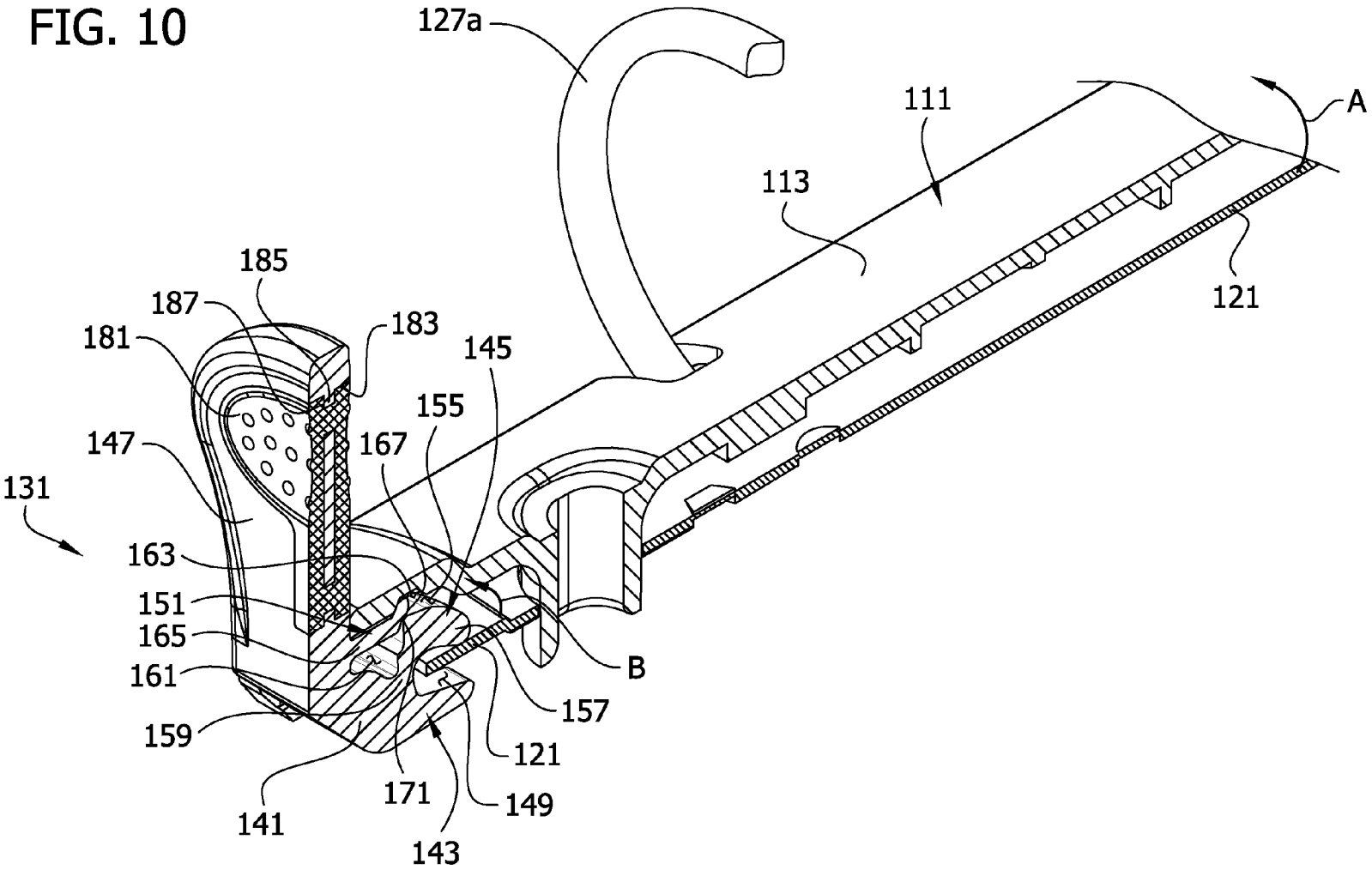
FIG. 10 is a perspective of the fragment of the ring binder mechanism in cross section as illustrated in FIG. 9.

As illustrated in FIGS. 9-14, the closing arm 145 suitably extends into a space 155 between the hinge plates 121 and the central portion 113 of the housing 111. The ends of the hinge plates 121 suitably extend into a notch 149 between the opening and closing arms 143, 145. The opening arm 143 is positioned beneath the hinge plates 121 so rotation or other movement of the actuator 131 relative to the housing 111 can cause the opening arm to push upwardly on the hinge plates and pivot them toward their open position. As illustrated in FIGS. 9 and 10, the opening arm 143 is suitably spaced from the hinge plates 121 when the rings 125 and actuator 131 are in the closed position. Accordingly, movement of the actuator 131 from the closed position toward the open position can be initiated without requiring immediate movement of the hinge plates 121 away from their closed position.

The closing arm 145 is suitably positioned above the hinge plates 121 so rotation or other movement of the actuator 131 relative to the housing 111 can cause the closing arm to push down on the hinge plates and pivot them toward their closed position to close the rings 125. For reasons that will become apparent, the closing arm 145 suitably has a relatively wider head 157 connected to the body 141 of the actuator 131 by a relatively narrower neck 159. The locking finger 151 extends from the body 141 of the actuator 131 at a location spaced from the location where the neck 159 of the closing arm 145 is connected to the body of the actuator. The actuator 131 has a void 161 in a space between the closing arm 145 and the locking finger 151. The head 157 of the closing arm 145 is suitably spaced from the locking finger 151 when the actuator 131 is in an undeformed condition, as illustrated in FIGS. 4 and 5.

A cavity 163 is formed in the underside of the central portion 113 of the housing 111, as illustrated in FIGS. 9-14. The locking finger 151 extends into the cavity 163 when the actuator 131 is in the closed and locked position (FIGS. 9 and 10). The locking finger 151 can have various configurations within the scope of the invention. In the illustrated embodiment, the locking finger 151 includes a segment 165 configured to extend a short distance along the bottom of the central portion 113 of the housing 111 when the rings 125 are closed and an upturned end 167 that is positioned and configured to extend into the cavity 163 when the actuator 131 is in the closed position.

Figure 11:
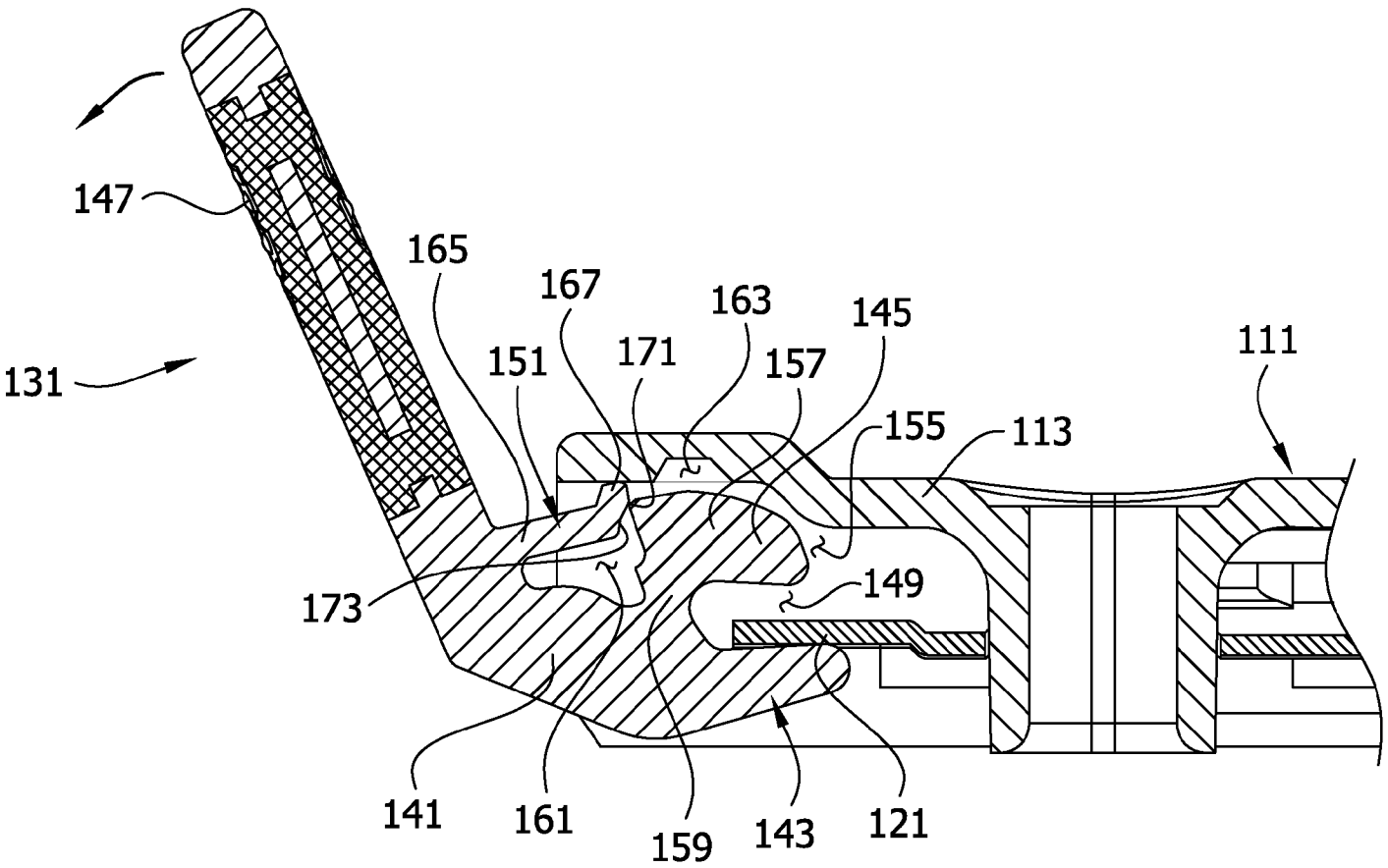
FIG. 11 is an enlarged longitudinal cross section of a fragment of the ring binder mechanism similar to FIG. 9, but showing the actuator in the process of being moved to open the rings.
Figure 12:
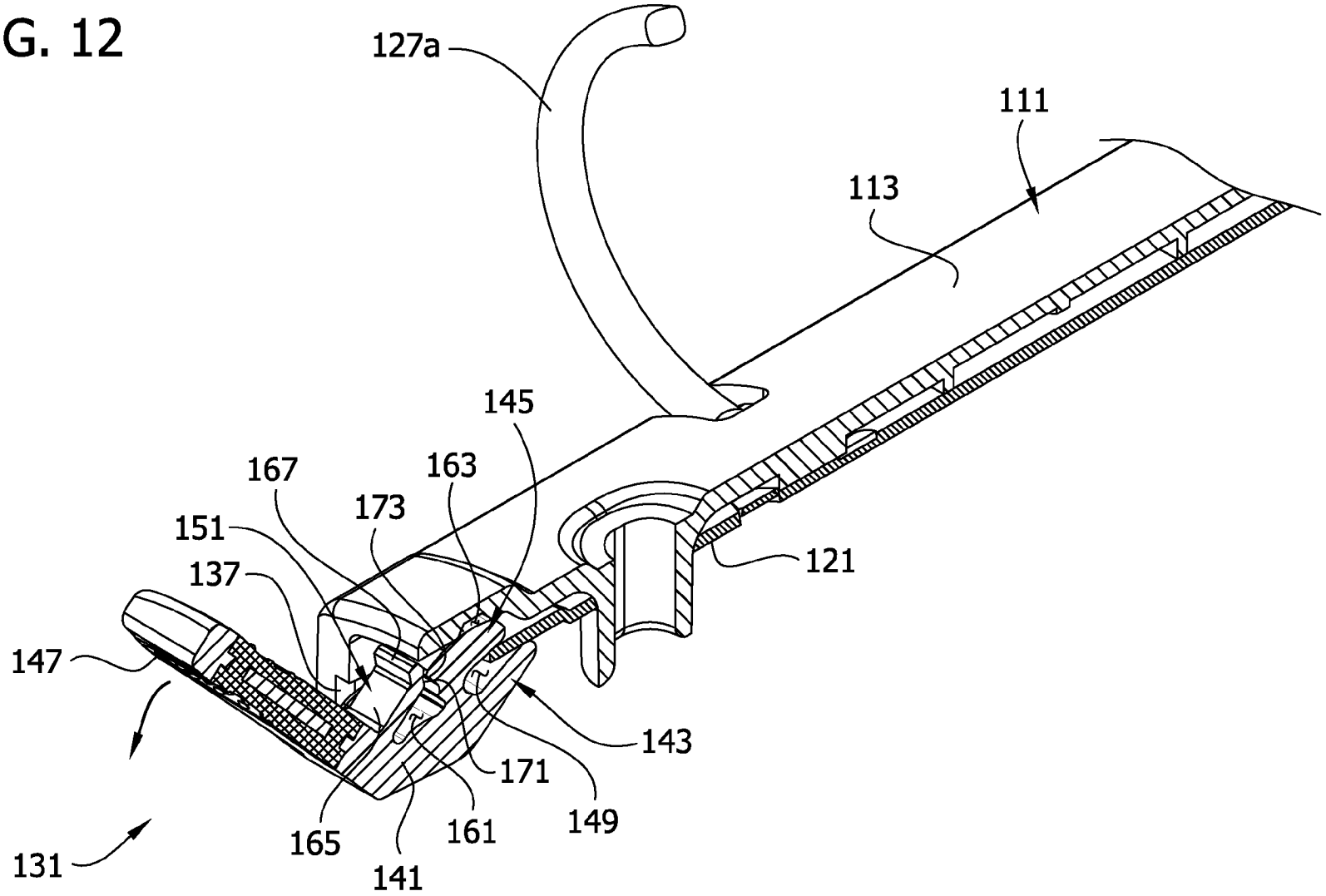
FIG. 12 is a perspective of the fragment of the ring binder mechanism in cross section as illustrated in FIG. 11.
Figure 13:
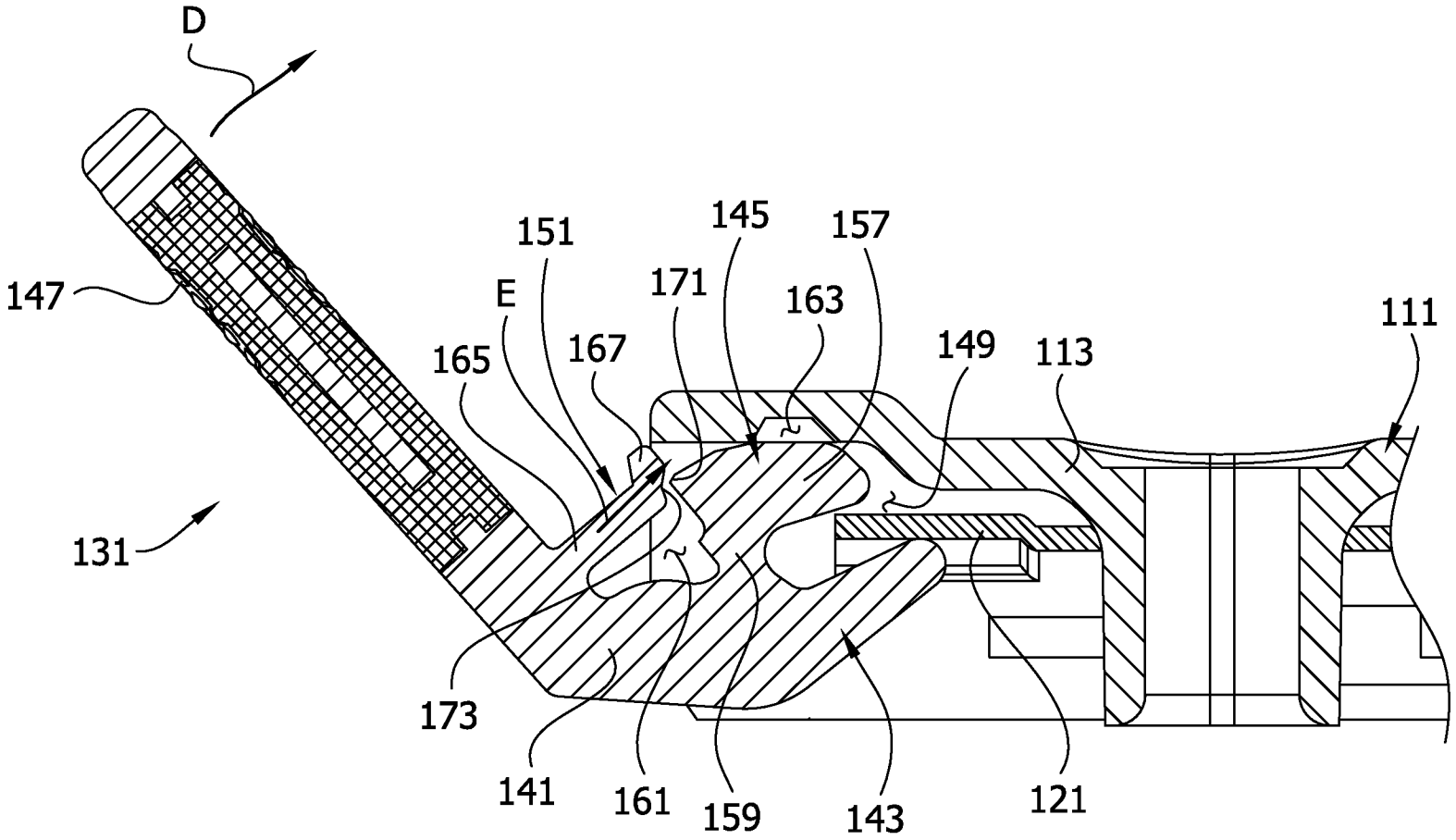
FIG. 13 is an enlarged longitudinal cross section of a fragment of the ring binder mechanism similar to FIGS. 9 and 11, but showing the position of the actuator after the rings have been opened.
Figure 14:
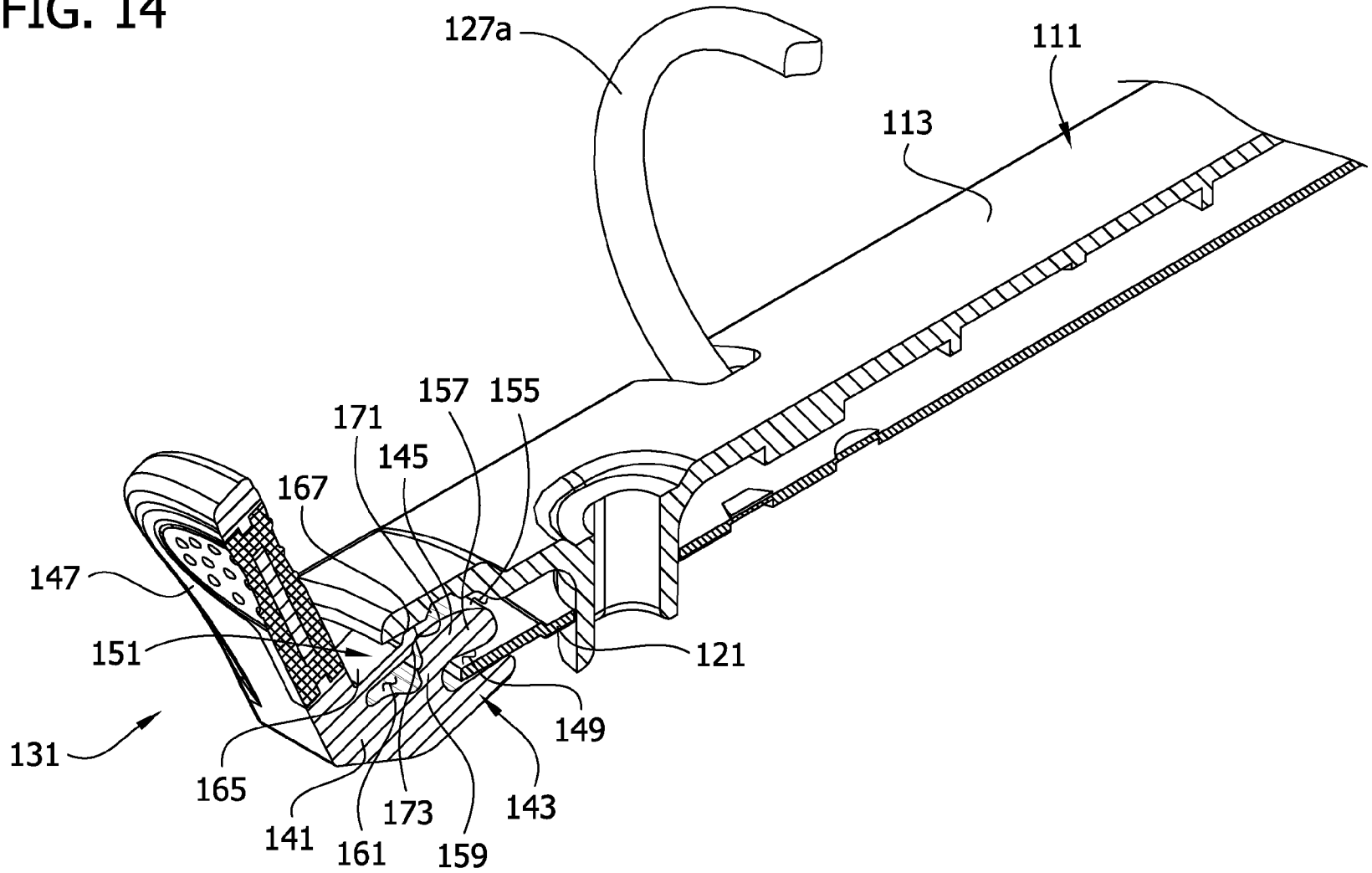
FIG. 14 is a perspective of the fragment of the ring binder mechanism in cross section as illustrated in FIG. 13.

The locking finger 151 is suitably relatively thin compared to the handle 147, opening arm 143, and head 157 of the closing arm 145. The locking finger 151 is suitably slightly thinner than the neck 159 of the closing arm 145, as illustrated in FIGS. 9 and 10. Moreover, the locking finger 151 is suitably configured so there is relatively little resistance to deformation (e.g., bending) of the locking finger in a manner that results in vertical movement of the upturned end 167 of the locking finger when a force is applied to the handle 147 to move the actuator 131 toward its open position. For example, the relative thinness of the locking finger 151 allows the locking finger 151 to deform (e.g., bend) readily so the upturned end 167 of the locking finger can be withdrawn from the cavity 163 by rotating the actuator 131 from the closed position toward the open position, as illustrated in FIGS. 11 and 12.

However, the hinge plates 121, closing arm 145, and locking finger 151 are positioned so that when the actuator 131 is in the closed position a force applied to the hinge plates 121 tending to move the hinge plates to pivot the ring members to the open position (as indicated by the arrow A in FIGS. 9 and 10) tends to deform the closing arm so the deformed the closing arm provides increased resistance to withdrawal of the locking finger from the cavity 163 in the housing to help limit movement of the locking finger out of the cavity 163 compared to the resistance provided by the undeformed closing arm.

For example, the closing arm 145 is suitably positioned and arranged so an upward force applied to the closing arm by the hinge plates 121 (as indicated by arrow A in FIGS. 9 and 10) causes the head 157 of the closing arm to move (e.g., by bending of the closing arm at the neck 159 as indicated by arrow B in FIGS. 9 and 10) from a position in which it provides relatively less resistance to the type of deformation of the locking finger 151 that allows the locking finger to be withdrawn from the cavity 163 to a position in which it provides relatively greater resistance to the type of deformation of the locking finger that allows the locking finger to be withdrawn from the cavity. As illustrated in FIG. 5, for example, when the closing arm 145 is in its undeformed configuration, the end 167 of the locking finger 151 can move downward (as indicated by arrow C in FIG. 5) a short distance before it contacts the closing arm. As illustrated in FIGS. 9 and 10, when an upward force is applied to the closing arm 145 by the hinge plates 121 (as indicated by arrow A in FIGS. 9 and 10) the head 157 of the closing arm bends at the neck and the head 157 moves into a position (e.g., farther under the locking finger 151) in which it blocks downward movement of the end 167 of the locking finger to withdraw the end of the locking finger from the cavity 163. When the head 157 of the closing arm 145 is in the blocking position, the end 167 of the locking finger 151, the back edge 171 of the head of the closing arm, and the neck 159 of the closing arm are positioned (e.g., aligned) so any reaction forces applied to the closing arm by the locking finger during attempted movement of the hinge plates toward the opening position result in compression of the neck and produce substantially no bending moment in the neck of the closing arm. Accordingly, upward forces applied to the closing arm 145 by the hinge plates 121 create an unopposed bending moment in the neck tending to hold the closing arm under the upturned end 167 of the locking finger 151 when forces tend to move the hinge plates 121 toward their open position without use of the actuator 131 to open the rings.

As illustrated in FIGS. 9 and 10, the closing arm 145 has a back edge 171 on the head 157 that is positioned to contact the locking finger 151 when the actuator 131, and in particular the closing arm thereof, is deformed by an opening force applied thereto by the hinge plates 121. The locking finger 151 has a groove 173 positioned so the back edge 171 of the head 157 of the closing arm 145 is received in the groove when it contacts the locking finger, as illustrated in FIG. 9. For example, the groove 173 is suitably positioned at the end of the laterally extending portion 165 of the locking finger 151 (e.g., under the upturned end 167).

The locking finger 151 suitably does not block movement of the actuator 131 toward the open position in response to force applied to the handle 147 to move the actuator toward the open position. As illustrated in FIGS. 11 and 12, the actuator 131 can be moved from the closed position to an intermediate position between the open and closed position by applying a force to the handle 147 in the direction of the arrows in FIGS. 11 and 12. Upon application of this force to the closed actuator 131, the end 167 of locking finger 151 is pulled out of the cavity 163 in housing 111 (e.g., by bending of the locking finger as indicated by arrow C in FIG. 5). During this time, the opening arm 143 moves upward toward the hinge plates 121 and eventually contacts the hinge plates after the locking finger 151 has been withdrawn from the cavity 163. Because the opening arm 143 was not in contact with the hinge plates 121 in the closed position of the actuator 131, initial movement of the actuator away from the closed position does not require application of any force to the hinge plates until after the locking finger 151 has been withdrawn from the cavity 163. Once the actuator 131 has been moved from the closed position to the intermediate position, the rings 125 can be opened either by continuing to move the actuator toward the open prostitution or by pulling the ring members 127 apart.

The locking finger 151 is suitably positioned and configured to limit deformation of the closing arm 145 during use of the actuator 131 to close the rings 125. For example, the locking finger 151 is suitably adjacent the closing arm 145 when the actuator is in its non-deformed state. Moreover, the locking finger 151 is positioned and configured so a force can be transmitted to the closing arm 145 from the handle 147 through the locking finger 151 and so that reaction forces applied to the locking finger by the closing arm are oriented to generally align with the axial length of the locking finger to limit bending moments in the segment 165 of the locking finger between the handle and the closing arm during use of the actuator 131 to close the rings. Accordingly, the closing arm 145 will deform slightly (e.g., bend at the neck 159) during use of the actuator 131 to close the rings 125 as the closing arm starts pushing the hinge plates 121 toward the closed position. However, once the closing arm 145 contacts the locking finger 151, the locking finger limits further bending of the closing arm and thereby facilitates efficient transmission of force from the handle 147 to the hinge plates 121 through the closing arm.

Figure 15:
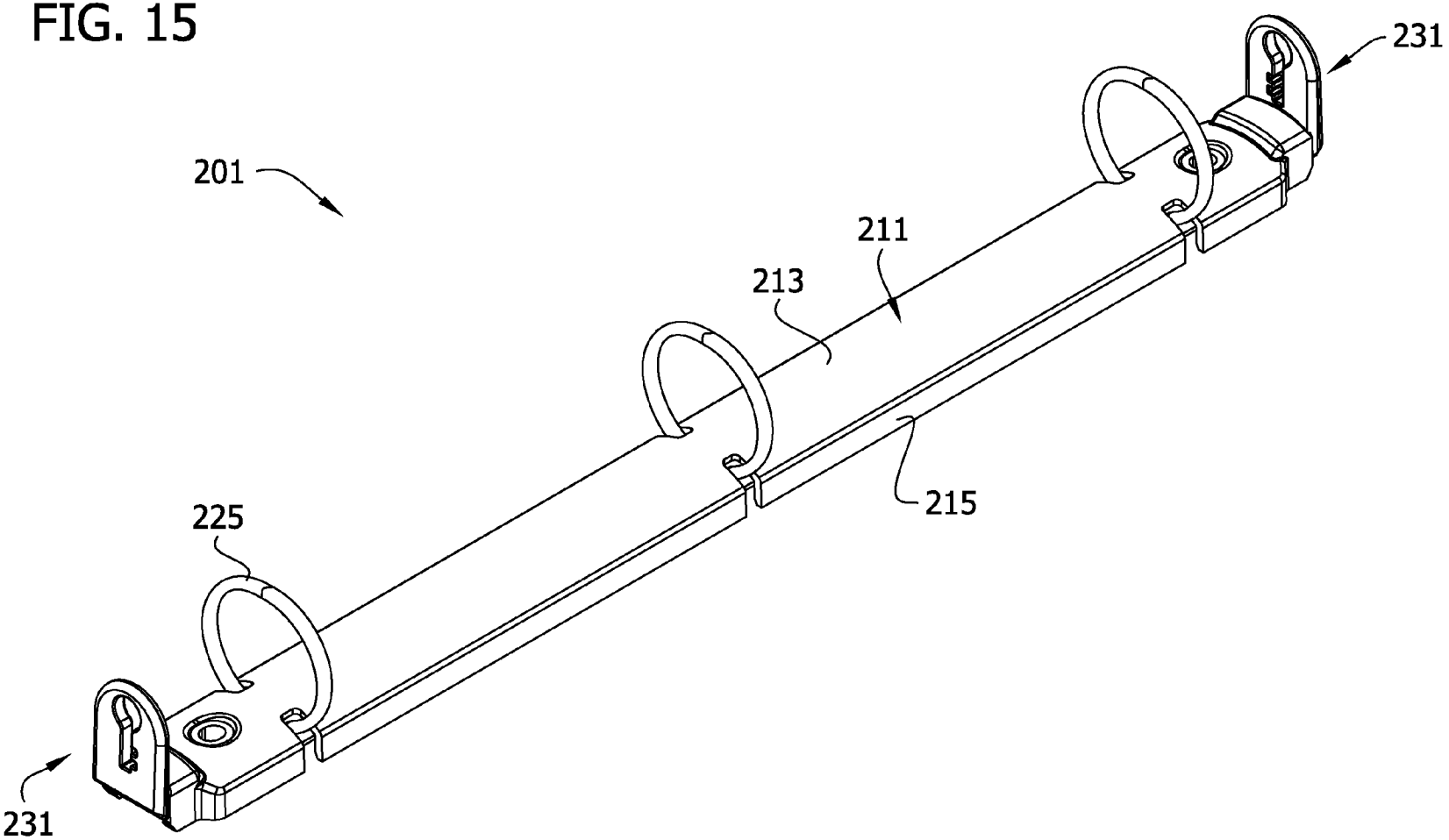
FIG. 15 is a perspective of another embodiment of a ring binder mechanism.
Figure 16:
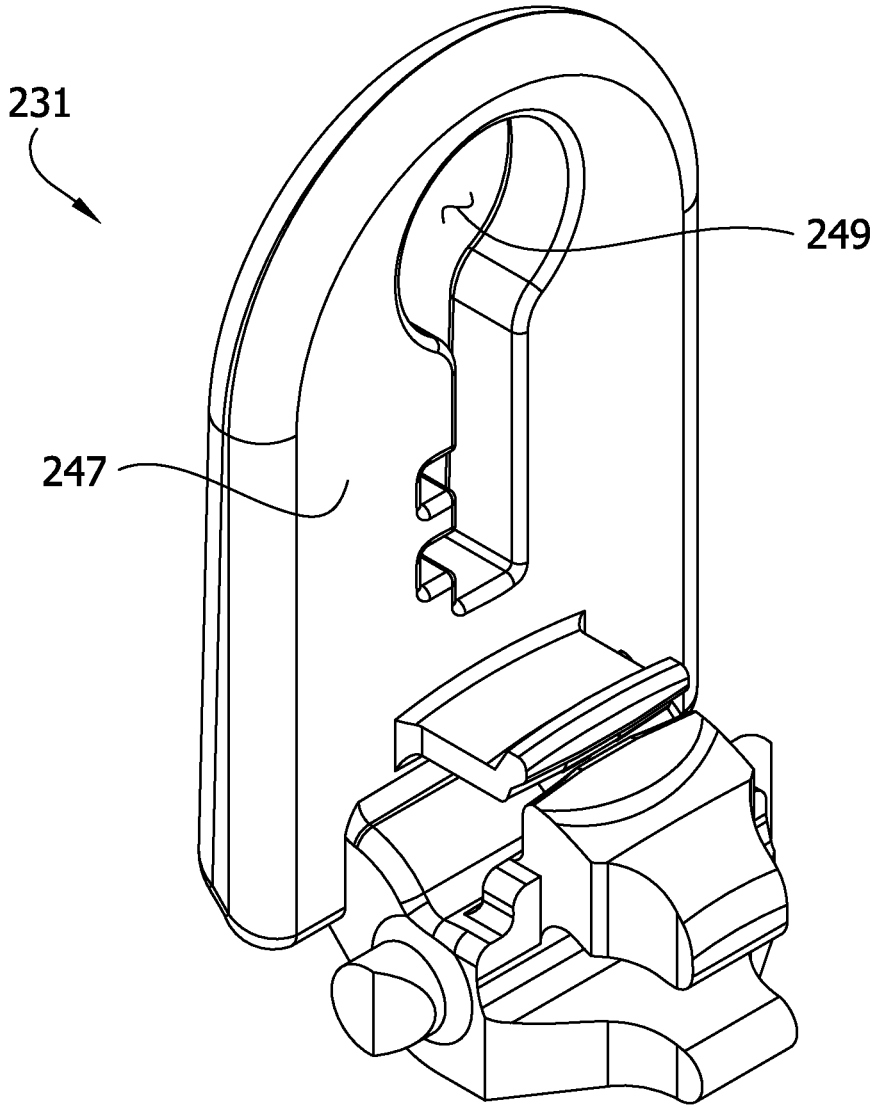
FIG. 16 is an enlarged perspective of another embodiment of an actuator for a ring binder mechanism.
Figure 17:
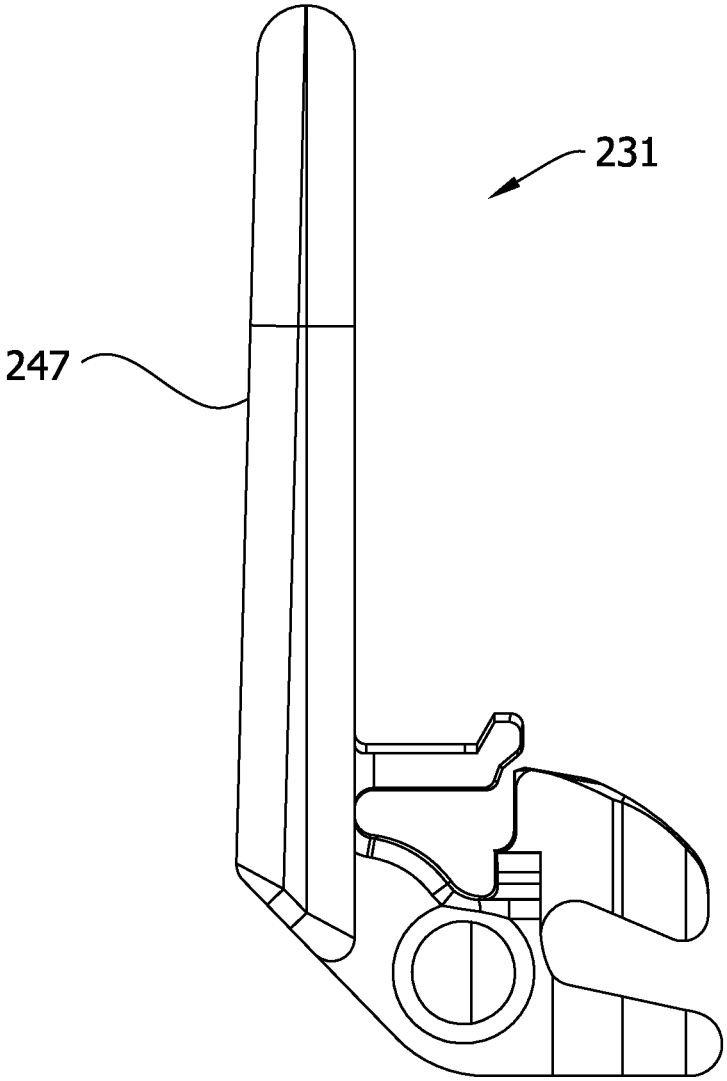
FIG. 17 is an enlarged side elevation of the actuator shown in FIG. 16.
Figure 18:
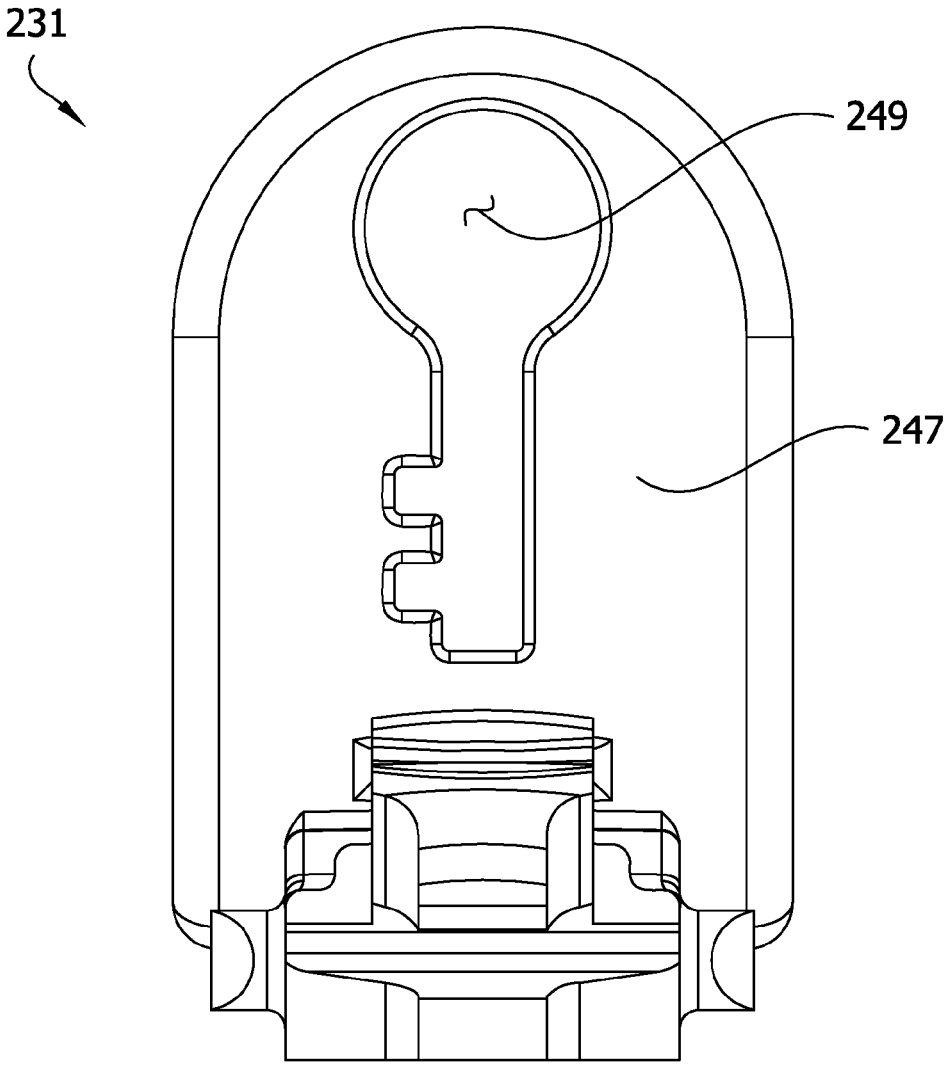
FIG. 18 is an enlarged front elevation of the actuator shown in FIG. 16.
Figure 19:
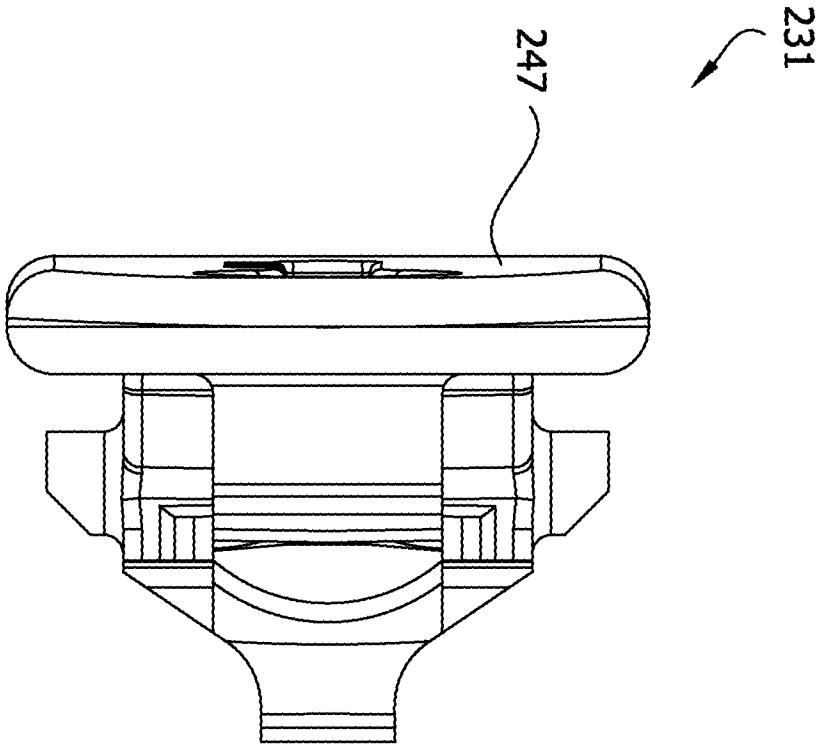
FIG. 19 is an enlarged top plan of the actuator shown in FIG. 16.

FIG. 15 shows another embodiment of a ring binder mechanism 201 of the present invention. Except as noted, the ring binder mechanism in FIG. 15 is identical to the ring binder mechanism 101 described above. One difference is that there are two actuators 231 in this ring mechanism, one at each end of the ring mechanism. Each of the actuators 231 is substantially identical to the actuator 131 described above, except for the handle 247. Each of the two actuators 231 is identical in the illustrated embodiment, but this is not required. As illustrated in FIGS. 16-19, which illustrate one of the actuators 231, the actuator handle 247 has a unitary one-piece construction. Furthermore, there is an ornamental key-shaped opening 249 in the center of the upright portion of the handle 247.

Operation of the ring binder mechanism 201 is substantially identical to the operation of the ring binder mechanism 101 described above, except that each of the two actuators 231 must be moved from the closed position to the intermediate position before the rings can be opened by either continuing to move one or both of the actuators toward the open position or by pulling the ring members apart after the actuators are in the intermediate position. Likewise, to close the rings 125 the actuators 231 can be moved from the open position to the closed position to close and lock the rings.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "upward" and "downward" and variations of these terms, or the use of other directional and orientation terms, is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. An actuator for moving the rings of a ring binder mechanism between open and closed positions, the actuator comprising:

a body;

a handle extending from the body;

an opening arm extending from the body;

a closing arm extending from the body, the closing arm having a relatively thicker head and a relatively thinner neck connecting the head to the body of the actuator so that any bending of the closing arm during use of the actuator to close the rings is concentrated in the neck of the closing arm, the head of the closing arm being spaced from an end of the opening arm to form a notch for receiving hinge plates of the ring mechanism between the opening and closing arms; and a locking finger extending from the body and having an upturned end, wherein the locking finger extends from the body at a location spaced from the neck of the closing arm toward the head of the closing arm, the upturned end of the locking finger being positioned adjacent the head of the closing arm.

2. An actuator as set forth in claim 1 wherein the locking finger is configured to have less resistance to deformation of the locking finger in a manner that results in movement of the upturned end of the locking finger in a direction parallel to the handle than it has to deformation of the locking finger in a manner that results in lateral movement of the upturned end of the locking finger in a direction that is perpendicular to the handle.

3. An actuator as set forth in claim 1 wherein the locking finger has a thickness that is thinner than the neck of the closing arm at a thinnest point of the neck.

4. An actuator as set forth in claim 1 wherein the closing arm is configured so that a force applied to the closing arm in the direction that the handle extends away from the body deforms the closing arm in a manner that moves the head of the closing arm into a position in which the head of the closing blocks movement of the upturned end of the locking finger in a direction opposite said force applied to the closing arm.

5. An actuator as set forth in claim 1 wherein the head of the closing arm has a back edge and the locking finger has a groove positioned to receive the back edge of the head of the closing arm when the closing arm is deformed by a force applied to the closing arm in a direction that the handle extends away from the body.

6. An actuator as set forth in claim 1 wherein the locking finger is made of a flexible material.

7. An actuator as set forth in claim 1 wherein the actuator is made of a moldable polymeric material.

8. An actuator as set forth in claim 1 wherein the locking finger has a generally straight segment extending from the body to the upturned end.

9. An actuator as set forth in claim 1 wherein the locking finger has a bend where the upturned end of the locking finger is connected to the rest of the locking finger.

10. An actuator as set forth in claim 1 wherein the upturned end of the locking finger is configured to turn away from the closing arm.

11. An actuator as set forth in claim 1 wherein the upturned end of the locking finger extends from the rest of the locking finger in the direction the handle extends from the body.

12. An actuator as set forth in claim 1 wherein the locking finger has a concave upper surface at the upturned end of the locking finger.

* * * * *